US010968695B2

(12) United States Patent
Chen et al.

(10) Patent No.: US 10,968,695 B2
(45) Date of Patent: Apr. 6, 2021

(54) FIXING ASSEMBLY FOR ROLLER SHADE

(71) Applicant: Nien Made Enterprise Co., Ltd., Taichung (TW)

(72) Inventors: Lin Chen, Taichung (TW); Hai Bo Liang, Taichung (TW); Keng-Hao Nien, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 251 days.

(21) Appl. No.: 16/192,656

(22) Filed: Nov. 15, 2018

(65) Prior Publication Data

US 2020/0157882 A1 May 21, 2020

(51) Int. Cl.
*A47H 1/00* (2006.01)
*E06B 9/42* (2006.01)

(52) U.S. Cl.
CPC ..... *E06B 9/42* (2013.01)

(58) Field of Classification Search
CPC ..... E06B 9/42; E06B 9/50; E06B 9/40; A47H 1/14; A47H 1/142
See application file for complete search history.

(56) References Cited

U.S. PATENT DOCUMENTS 1,358,967 A * 11/1920 Mastalerz ..... A47H 1/13 248/255
4,538,785 A * 9/1985 Damsgaard ..... E06B 9/50 248/268
5,083,601 A * 1/1992 Tedeschi ..... E06B 9/50 160/323.1
6,457,688 B1 * 10/2002 Welfonder ..... E06B 9/174 160/323.1
6,550,733 B1 * 4/2003 Lassen ..... E06B 9/50 248/266
8,136,569 B2 * 3/2012 Bohlen ..... E06B 9/42 160/323.1
8,997,829 B2 * 4/2015 Kao ..... E06B 9/42 160/321
10,428,580 B2 * 10/2019 Vries ..... E06B 9/42
10,619,414 B2 * 4/2020 Ng ..... E06B 9/72
10,626,670 B2 * 4/2020 Cheng ..... E06B 9/50
10,704,324 B2 * 7/2020 Goldberg ..... E06B 9/50
2015/0007949 A1 * 1/2015 Daniels ..... E06B 9/56 160/323.1
2018/0128047 A1 * 5/2018 Ng ..... E06B 9/50
(Continued)

*Primary Examiner* — Johnnie A. Shablack
(74) *Attorney, Agent, or Firm* — Winston Hsu

(57) ABSTRACT

A fixing assembly is adapted to fix a main body of a roller shade to an environment, and is adapted to be installed at an end of a roller tube of the main body. The fixing assembly includes a fixing member, which corresponds to the roller tube when installed, and a fixing support corresponding to the fixing member. The fixing member includes a connecting portion and a snap-fitting portion connected to the connecting portion with an end thereof exposed out. The connecting portion can be connected to the end of the roller tube, whereby to fix the fixing member to the roller tube. The fixing support includes a fixing portion and a snap-fitted portion provided on a surface of the fixing portion facing the fixing member. The snap-fitting portion is detachably connected to the fixing support, and can be optionally engaged with the snap-fitted portion at different positions.

11 Claims, 9 Drawing Sheets

(56) References Cited

U.S. PATENT DOCUMENTS

| | | | | |
|---|---|---|---|---|
| 2019/0162021 | A1* | 5/2019 | De Vries | E06B 9/60 |
| 2019/0257149 | A1* | 8/2019 | Lei | E06B 9/60 |
| 2020/0157882 | A1* | 5/2020 | Chen | E06B 9/50 |

* cited by examiner

FIXING ASSEMBLY FOR ROLLER SHADE

BACKGROUND OF THE INVENTION

1. Field of the Invention

The present invention relates generally to a fixing assembly for roller shades, and more particularly to a fixing assembly which can be easily installed and is adjustable.

2. Description of the Prior Art

A conventional fixing assembly used for installing a roller shade generally includes installation frames and a fixing member, wherein each of the installation frames is fixed to a wall, and has a snap-fitting member. The fixing member is installed in the roller tube of the roller shade, and has a slot provided thereon. To install a roller shade, at least two installation frames should be fixed to a wall first, with one on the right and the other one on the left, and then the roller tube assembled with the fixing member can be connected to the installation frames in a snap-fitting manner. In this way, the roller tube of the roller shade can be fixed relative to the installation frames.

The problem of the structure above is that it is not easy to align the roller tube with the installation frames during installation, and the roller tube cannot be adjusted after the completion of installation. In addition, the installation frames on two sides may be fixed at different heights for several reasons, e.g., the worker has a poor skill or the wall for installing the installation frames is not even, etc. In such case, the roller tube of the roller shade will be skewed, i.e., not horizontal, which would be not good looking. Furthermore, a gap will be left between the top of the covering material of the roller shade and the architectural opening, leading to light leakage.

Therefore, how to conveniently install a roller shade so that the roller tube of the roller shade is horizontal to the ground after the completion of the installation is still a problem to be solved.

SUMMARY OF THE INVENTION

In view of the above, one aspect of the present invention is to provide a fixing assembly for roller shades, which is convenient to install and easy to disassemble, and the height of which can be adjusted. Therefore, the aforementioned problem that roller shades are unhandy to install and roller tubes may be skewed after installation could be resolved. At the same time, the amount of light leakage between the top of a covering material and the window opening could be reduced as well.

The present invention provides a fixing assembly, which is adapted to fix a main body of a roller shade to an external environment, wherein the main body includes a roller tube, a rolling assembly, and a covering material. An end of the covering material is connected to the roller tube. The rolling assembly is provided inside the roller tube to drive the roller tube to wind up the covering material. The fixing assembly is adapted to be installed at an end of the roller tube. The fixing assembly includes a fixing member and a fixing support. The fixing member corresponds to the roller tube when the fixing assembly is installed at the end of the roller tube, wherein the fixing member includes a connecting portion and a snap-fitting portion. The snap-fitting portion is connected to the connecting portion, and an end of the snap-fitting portion is exposed out of the connecting portion.

The connecting portion is adapted to be connected to an end of the roller tube, whereby to fix the fixing member to the roller tube. The fixing support corresponds to the fixing member, wherein the fixing support includes a fixing portion and a snap-fitted portion. The fixing portion is adapted to be fixedly connected to the external environment. The snap-fitted portion is fixedly provided on a surface of the fixing portion facing the fixing member. The snap-fitting portion of the fixing member is detachably connected to the fixing support. The snap-fitting portion of the fixing member is optionally snap-fitted with the snap-fitted portion at a first position or a second position.

With the aforementioned design, the fixing assembly provided in the present invention could provide the following advantages:

1. Through the cooperation between the fixing member, which has the insertion block and the elastic plate, and the fixing support, which has the installation groove and the guiding slope, the main body of the roller shade can be easily installed and disassembled.

2. The slot of each of the fixing supports has multiple openings arranged in a vertical direction, forming a ladder-like arrangement, whereby the main body of the roller shade can have its height adjusted relative to the fixing support. In this way, the roller tube of the roller shade could be maintained as horizontal, and therefore the problem that two fixing supports may locate at different heights could be solved; in addition, the light leakage between the top of the covering material and the wall could be reduced.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will be best understood by referring to the following detailed description of some illustrative embodiments in conjunction with the accompanying drawings, in which.

DETAILED DESCRIPTION

Figure 1:
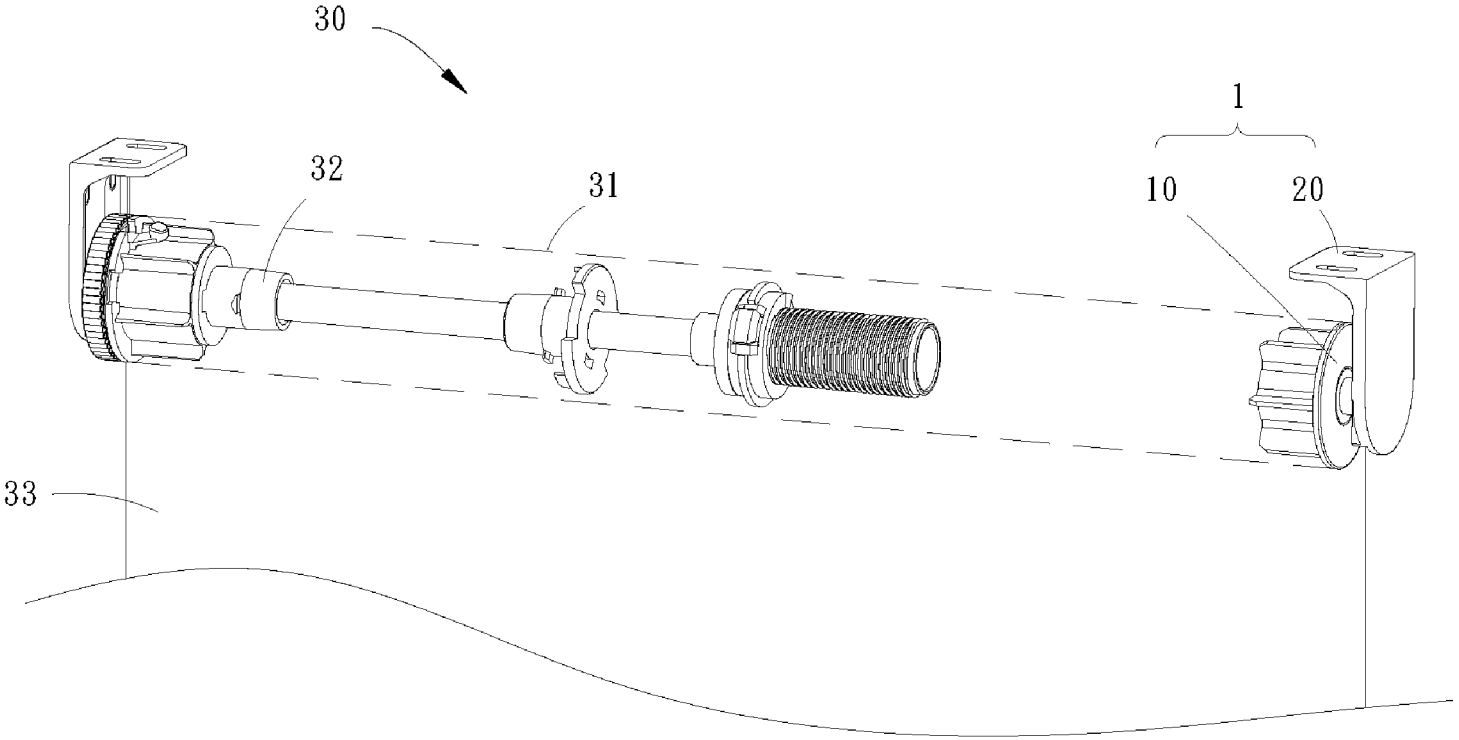
FIG. 1 is an exploded perspective view, showing how the fixing assembly of the present invention is assembled with a main body of a roller shade.

A fixing assembly 1 of an embodiment of the present invention is shown in FIG. 1 to FIG. 7, which can be applied to the installation of roll-up window coverings, such as roller shades, Roman shades, and double-layered roller shades. As shown in FIG. 1, a main body 30 of a type of roller shade includes a roller tube 31, a rolling assembly 32, and a covering material 33. An end of the covering material 33 is connected to the roller tube 31, whereby the covering material 33 is adapted to wrap around the roller tube 31; another end of the covering material 33 is freely suspended. The rolling assembly 32 is provided in the roller tube 31, and is adapted to drive the roller tube 31 to rotate. The mechanism the rolling assembly 32 uses to drive the rotation of the roller tube 31 is conventional technique, and therefore will not be further discussed herein; just to mention: the driving mechanism can be performed manually, or with a motor instead. When the rolling assembly 32 rotates, the roller tube 31 is driven to rotate, whereby the covering material 33 can be rolled up or released as the roller tube 31 rotates. In this way, the main body 30 of the roller shade can be changed between a light-blocking state and a non-blocking state. The fixing assembly 1 is provided at a top of the roller tube 31 to allow the main body 30 of the roller shade to be installed in an external environment, such as installed on a wall or inside a window frame, etc.

Figure 2:
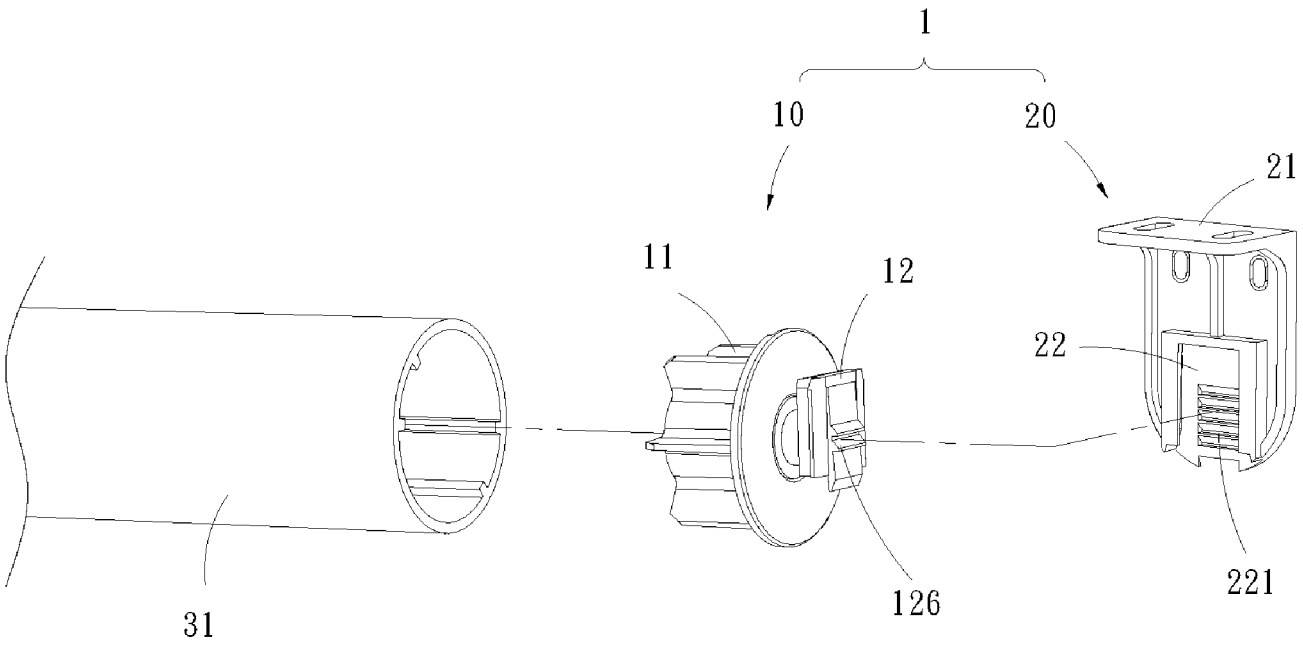
FIG. 2 is an exploded schematic view of the fixing assembly of FIG. 1 and the roller tube.
Figure 4:
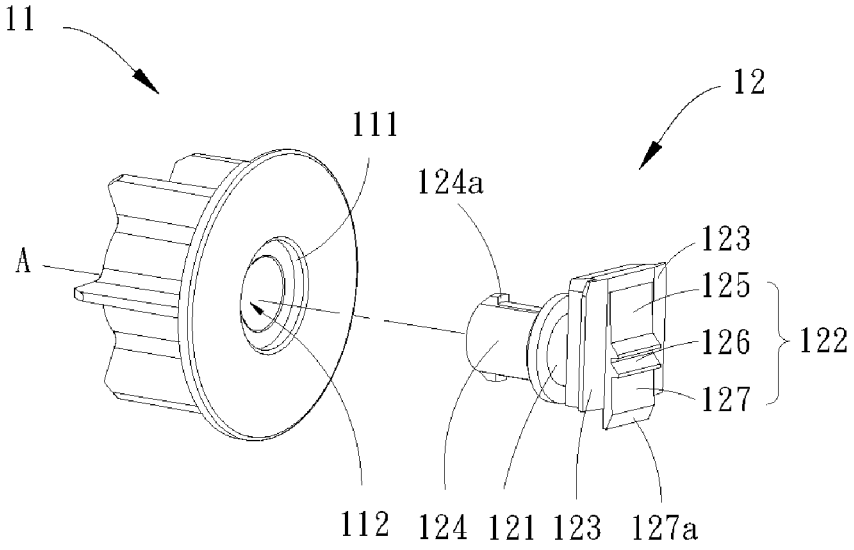
FIG. 4 is an exploded perspective view of the fixing member.
Figure 5:
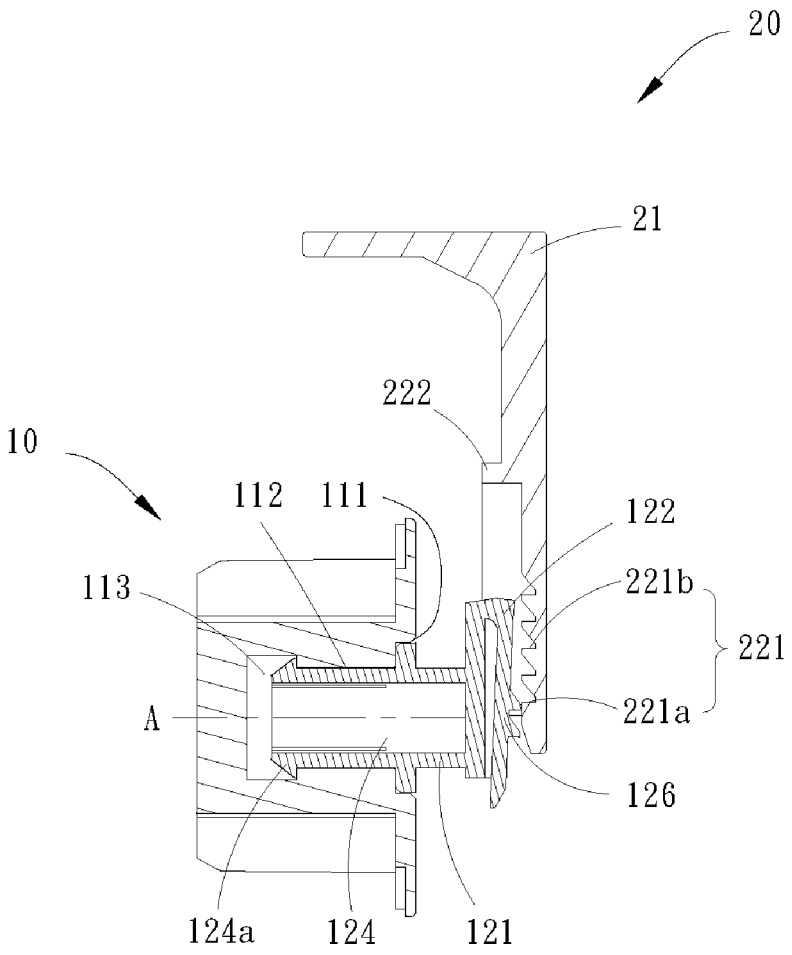
FIG. 5 is a sectional view showing the assembly process of inserting the fixing member into the fixing support.
Figure 6B:
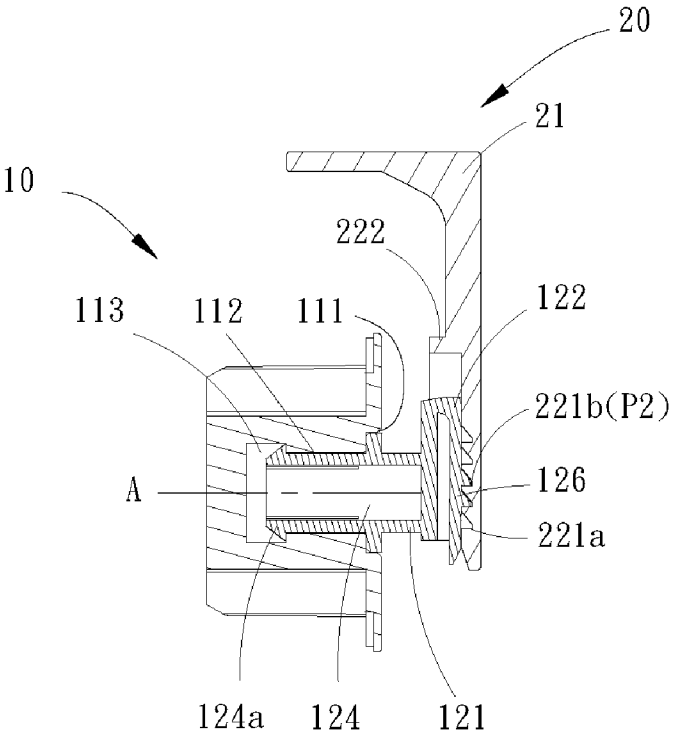
FIG. 6*b* is a sectional view showing the fixing member is located at a second position relative to the fixing support.
Figure 6A:
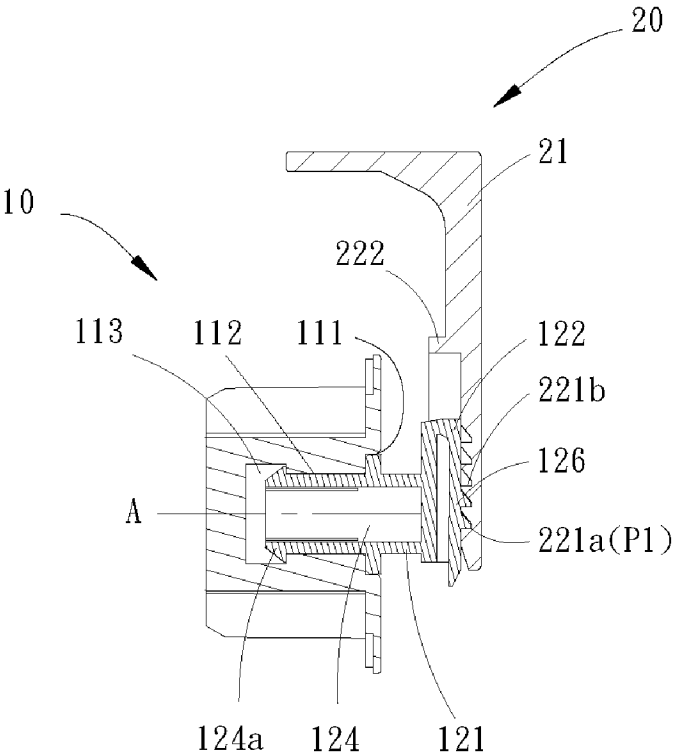
FIG. 6*a* is a sectional view showing the fixing member is located at a first position relative to the fixing support.

The structure of the fixing assembly 1 is described below. The fixing assembly 1 includes a fixing member 10 and a fixing support 20. As shown in FIG. 2 and FIG. 4, the fixing member 10 includes a connecting portion 11 and a snap-fitting portion 12. An end of the connecting portion 11 is adapted to be connected to an end portion of the roller tube 31, and a shape of the connecting portion 11 roughly corresponds to the shape of an inner wall of the roller tube 31, so that the connecting portion 11 can be inserted into the roller tube 31, and can be synchronously moved along with the roller tube 31. Another end of the connecting portion 11 is adapted to be connected to the snap-fitting portion 12, wherein the connecting portion 11 includes an inlet portion 111, a passage 112, and a bottom 113 at the another end thereof. As shown in FIG. 5, FIG. 6*a* and FIG. 6*b*, the connecting portion 11 is a hollow tube, which is roughly cylindrical, wherein an inner space of the connecting portion 11 is also roughly cylindrical, and is defined as the passage 112. The inlet portion 111 communicates with an end of the passage 112, rendering an opening facing the snap-fitting portion 12, wherein a diameter of said opening is slightly greater than that of the passage 112. Another end of the passage 112 away from the inlet portion 111 reaches the bottom 113, wherein the bottom 113 has a round groove, of which a diameter is slightly greater than that of the passage 112.

The snap-fitting portion 12 includes an insertion block 121, an elastic plate 122, two wings 123 and a post 124. In the current embodiment, the insertion block 121 includes a cylinder, and has a round plate and a square block which are respectively connected to two sides of the cylinder, as shown in FIG. 4, whereby the insertion block 121 looks like an "H" when viewed from a side. The elastic plate 122 includes a root 125, a toothed portion 126, and an end portion 127, wherein an end of the root 125 is connected to the insertion block 121, and another end thereof is connected to the toothed portion 126. Another end of the toothed portion 126 opposite to the root 125 is connected to the end portion 127. Therefore, the elastic plate 122 roughly forms an elastic arm which protrudes in a direction opposite to the connecting portion 11. A side of the toothed portion 126 opposite to the connecting portion 11 protrudes outward with ratchet teeth, and has a bevel 127*a*, which is provided at the end portion 127 on the same side with the protruded ratchet teeth, and extends to an end of the end portion 127. Two wings 123 are provided on two lateral sides of the insertion block 121, and protrude outward from the insertion block 121 as narrow, long plates. The post 124 is also connected to the insertion block 121, and extends from the insertion block 121 in a direction toward the connecting portion 11, forming a connecting shaft, which has an axis A. An end portion on a side of the post 124 facing the connecting portion 11 has an elastic snap-fitting component 124*a*. The way of connecting the connecting portion 11 and the snap-fitting portion 12 is explained below. The post 124 of the snap-fitting portion 12 is adapted to be inserted into the passage 112 through the inlet portion 111 of the connecting portion 11, and the elastic snap-fitting component 124*a* at the end portion of the post 124 gets engaged at the bottom 113 after passing through the passage 112. Once connected, one of the sides of the insertion block 121 abuts against the inlet portion 111, so that the connecting portion 11 and the snap-fitting portion 12 are connected in a way that they are rotatable relative to each other, but are not movable relative to each other. In other words, the connecting portion 11 can be rotated around the axis A of the post 124, but is not movable relative to the axis A in any direction other than the rotational direction. It is worth mentioning that, in the current embodiment, the insertion block 121 is a component with a narrow portion, which makes the insertion block 121 looks like an "H" when viewed from a side. However, this is not a limitation of the present invention. In other embodiments, the insertion block 121 could be a whole block or a simple cylinder, as long as the shape of the insertion block 121 does not hinder the smoothness of the rotation of the connecting portion 11 relative to the post 124.

Figure 3:
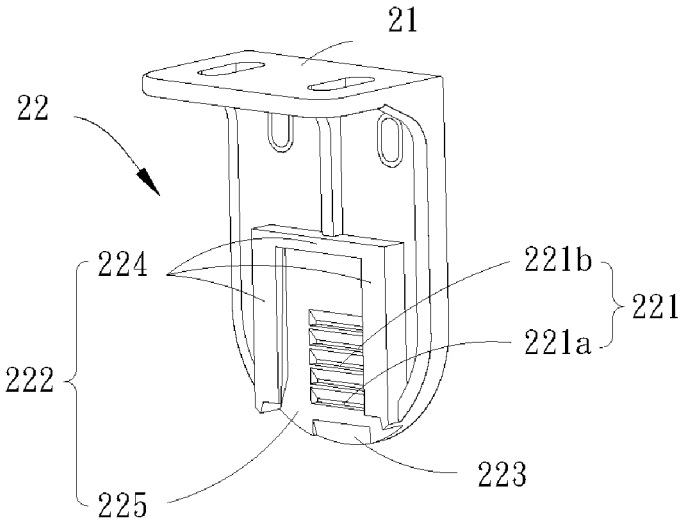
FIG. 3 is a perspective view of the fixing support.

As shown in FIG. 2 and FIG. 3, the fixing support 20 is roughly L-shaped, and includes a fixing portion 21 and a snap-fitted portion 22, wherein the fixing portion 21 has a plurality of perforations, which can be passed through by conventional fixing mechanisms such as screws, whereby the fixing portion 21 can be fixed to an external environment such as a wall, a window frame, etc. The snap-fitted portion 22 is fixedly provided on a side of the fixing portion 21 facing the fixing member 10, and the snap-fitted portion 22 includes a slot 221, an install groove 222, and a guide slope 223. The slot 221 has a plurality of openings, which are arranged in a vertical direction, forming a ladder-like arrangement. The openings include an opening 221*a* and an opening 221*b*. The install groove 222 includes three outer walls 224, which together form a reversed, flat-bottomed U shape with a downward groove exit 225. The guide slope 223 is connected to a location adjacent to the groove exit 225. The plurality of openings 221*a*, 221*b* of the slot 221 are located inside the space defined by the outer walls 224 of the install groove 222. The outline of each of the openings 221*a*, 221*b* matches the outline of each of the protruded ratchet teeth of the toothed portion 126.

The installation and the disassembling of the fixing assembly 1 applied to the main body 30 of the roller shade are explained below. To install the main body 30 of the roller shade onto a wall, the fixing support 20 of the fixing assembly 1 should be first fixed at an appropriate position on a wall or a window frame with conventional fixing mechanisms, such as screws, passing through the perforations thereof, and then the main body 30 of the roller shade which is assembled with the fixing member 10 could be pushed upward to where the fixing support 20 is. During such process, the wings 123 provided on the two sides of the insertion block 121 would first pass through the groove exit 225 of the install groove 222 of the fixing support 20, and then would fit into the space defined by the outer walls 224. At this time, as shown in FIG. 5, the elastic plate 122 on the insertion block 121 has also been guided into the slot 221 on the inner side of the install groove 222, so that the toothed portion 126 of the elastic plate 122 could contact the opening 221*a* of the slot 221. Since the elastic plate 122 is made of elastic materials, it would be slightly bent inward, which is sufficient to allow the toothed portion 126 to move inside the install groove 222, whereby the toothed portion 126 could snap-fit into the opening 221*a*. In this way, the fixing member 10 can be engaged with the fixing support 20 at a first position P1, as shown in FIG. 6*a*. Through the cooperation between the install groove 222 and the insertion block 121, namely the guiding effect provided by the outer walls 224 and the wings 123, the main body 30 of the roller shade could be quickly and conveniently installed.

When the fixing member 10 is pushed upward again by an external force, the elastic plate 122 would be slightly bent inward again, so that the toothed portion 126 could be disengaged from the originally engaged opening 221*a*, and then moved upward to snap-fit into the next opening 221*b*. At this time, the fixing member 10 is once again engaged with the fixing support 20, but at a second position P2 this time, as shown in FIG. 6*b*. It is worth mentioning that, in the current embodiment, the openings 221*a*, 221*b* are ratchet tooth-shaped matching the toothed portion 126, so that the openings 221*a*, 221*b* and the toothed portion 126 of the elastic plate 122 could form a unidirectional engaging mechanism. In other words, when the fixing member 10 which has the toothed portion 126 is pulled downward by an external force, the fixing member 10 could remain unmoved relative to the fixing support 20; when the fixing member 10 which has the toothed portion 126 is pushed upward by an external force, the elastic plate 122 would be also slightly bent by a horizontal component of force derived from the vertical force, for the contact surfaces between the openings 221*a*, 221*b* and the toothed portion 126 are inclined. As a result, the toothed portion 126 could be therefore disengaged from the openings 221*a*, 221*b*, and the fixing member 10 could be moved upward relative to the fixing support 20. With the aforementioned design, by pushing upward the end of the main body 30 of the roller shade which is assembled with the fixing member 10, the fixing member 10 can be engaged with the openings 221*a*, 221*b* at different positions as required. In this way, the position of the main body 30 of the roller shade relative to the fixing support 20 can be adjusted, and therefore the height and the level of the roller tube 31 can be adjusted.

Figure 7:
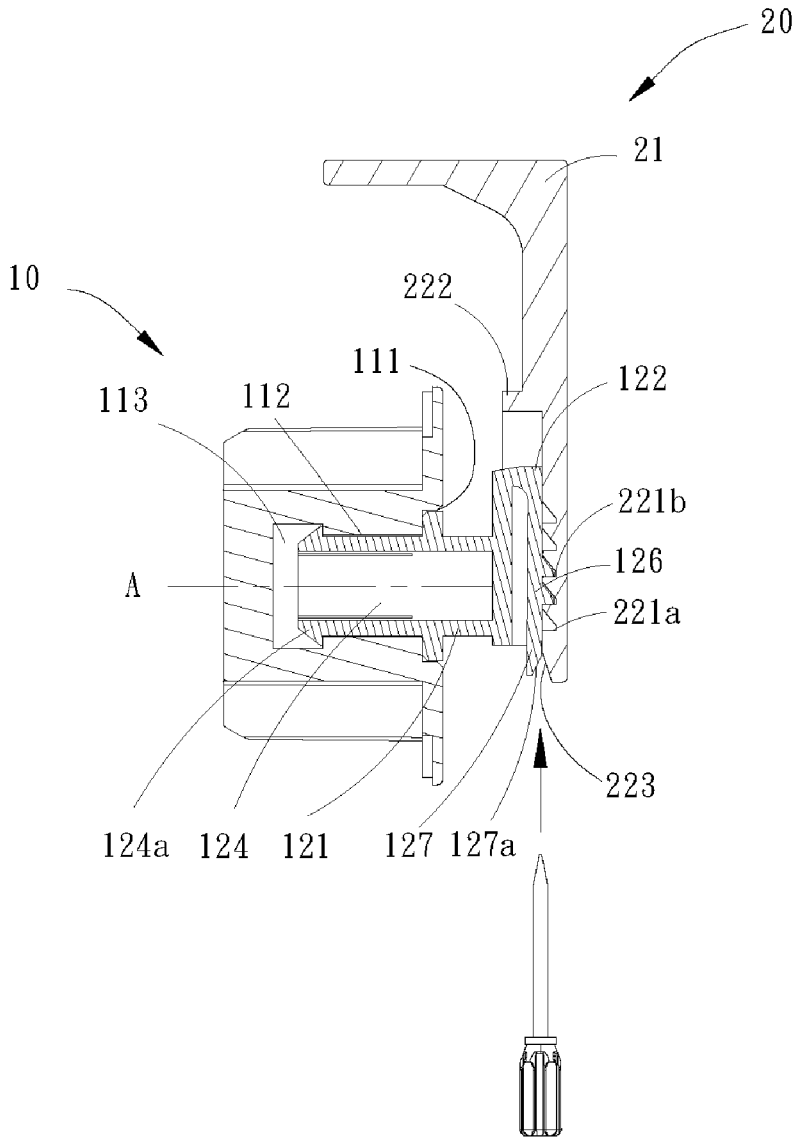
FIG. 7 is a sectional view showing how to disengage the fixing member from the fixing support with a tool.

As shown in FIG. 7, to disassemble the main body 30 of the roller shade, just insert a slender tool, such as a flathead screwdriver, into the groove exit 225 of the install groove 222 of the fixing support 20 to press the end portion 127 of the elastic plate 122 of the fixing member 10, whereby the toothed portion 126 of the elastic plate 122 would leave the engaged opening 221*a*, 221*b*, dismissing the engagement between the fixing member 10 and the fixing support 20. After that, by pulling down the side of the roller tube 31 corresponding to the fixing member 10, the insertion block 121 and the wings 123 would retreat out of the install groove 222, and therefore the roller tube 31 could be disassembled from the fixing support 20. The guide slope 223 adjacent to the groove exit 225 and the bevel 127*a* of the end portion 127 of the elastic plate 122 both provide the function of guiding a tool into the install groove 222, which could enhance the usability while using a tool.

Figure 8:
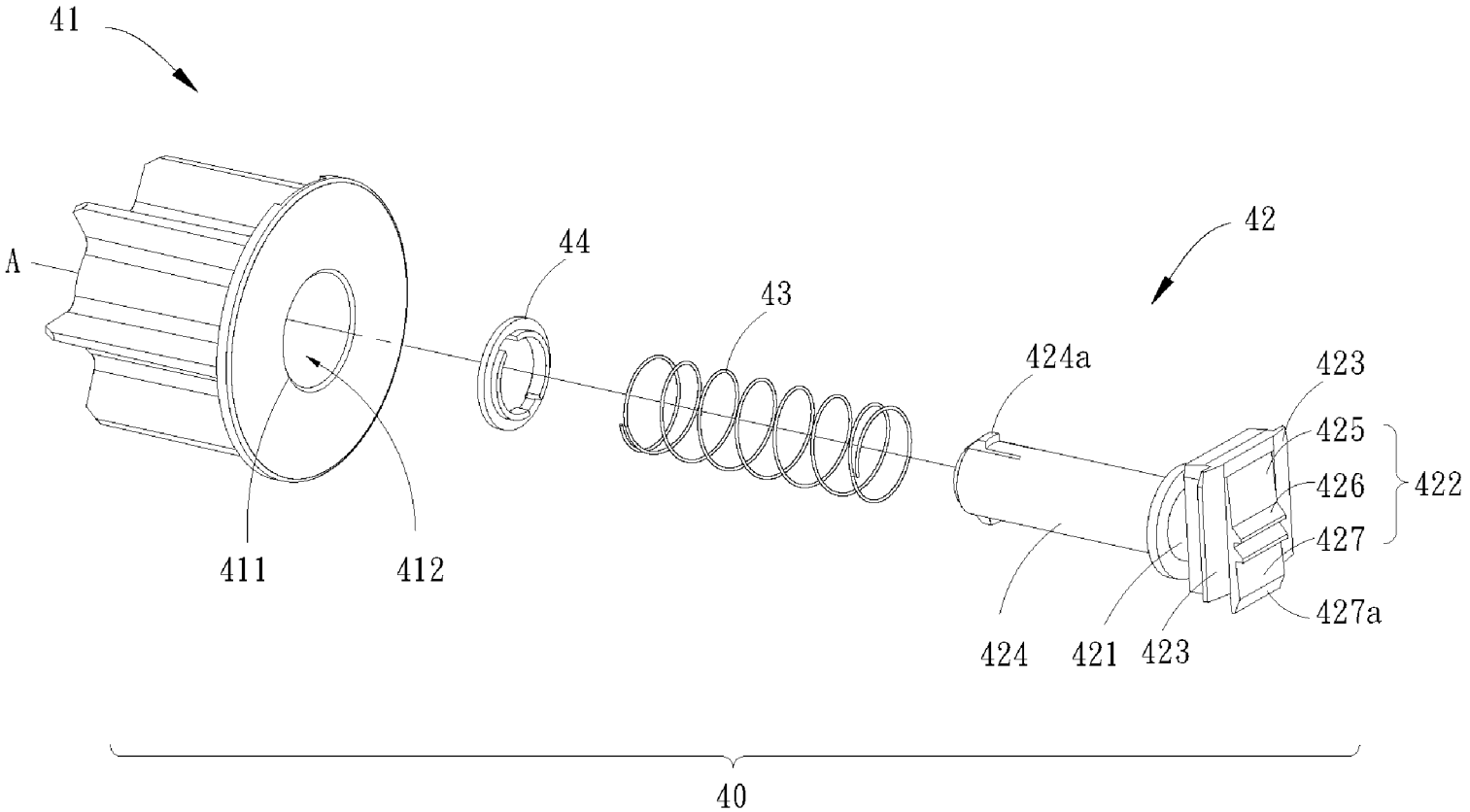
FIG. 8 is an exploded perspective view of the fixing member of another embodiment.
Figure 9:
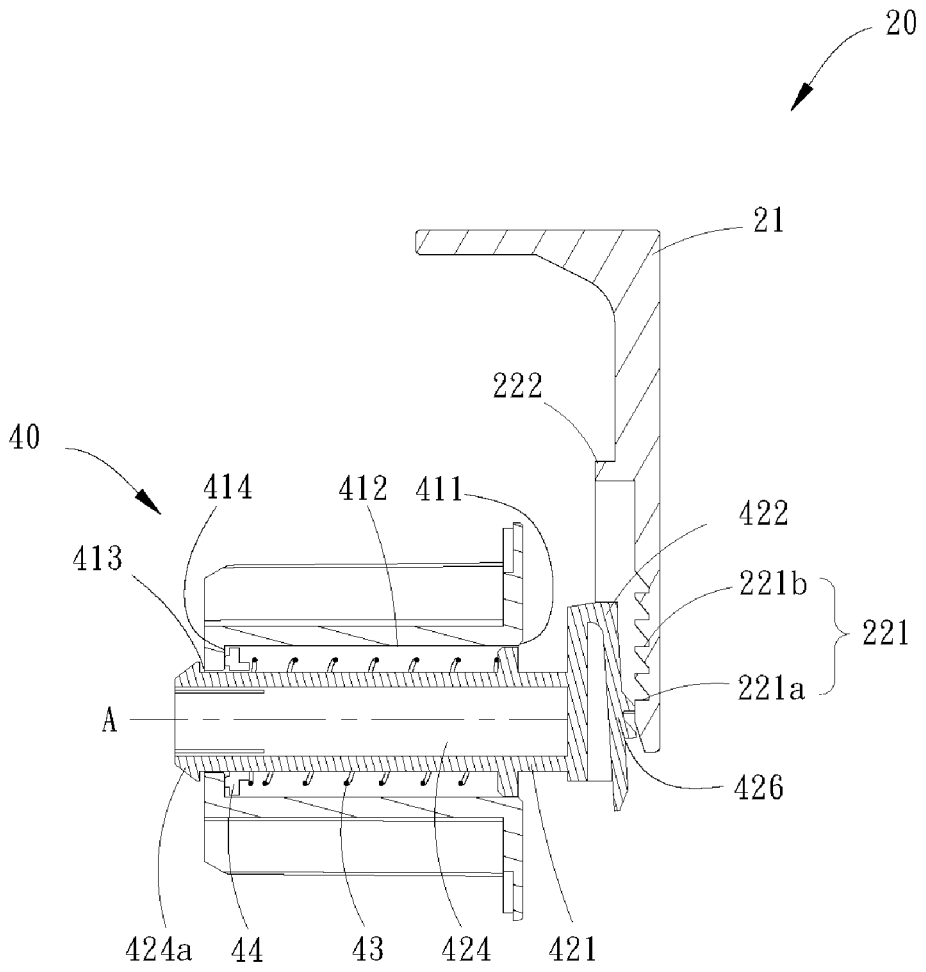
FIG. 9 is a sectional view showing the assembly process of inserting the fixing member shown in FIG. 8 into the fixing support.

Another embodiment of a fixing member of a fixing assembly for roller shades is shown in FIG. 8 to FIG. 10, which also can be applied to the installation of the main body 30 of the roller shade shown in FIG. 1. The fixing member 40 includes a connecting portion 41, a snap-fitting portion 42, an elastic member 43, and a rotary ring 44. The snap-fitting portion 42 has approximately the same structure with the snap-fitting portion 12 of the first embodiment, and includes an insertion block 421, an elastic plate 422, two wings 423, and a post 424. The elastic plate 422 is an elastic arm protruding in a direction opposite to the connecting portion 41, and includes a root 425, a toothed portion 426, and an end portion 427. The end portion 427 has a bevel 427*a* provided thereon, wherein the bevel extends to an end of the end portion 427. The post 424 is also connected to the insertion block 421, and extends from the insertion block 421 in a direction toward the connecting portion 41 as a connecting shaft. The post 424 is defined to have an axis A. An end portion on a side of the post 424 facing the connecting portion 41 has an elastic snap-fitting component 424*a* provided thereon. The wings 423 are provided on two lateral sides of the insertion block 421, and protrude from the insertion block 421 as narrow and long plates.

An end of the connecting portion 41 is adapted to be connected to an end portion of the roller tube 31, and has a shape which roughly matches the roller tube 31; another end of the connecting portion 41 is adapted to be connected to the snap-fitting portion 42. The major difference from the first embodiment is that the connecting portion 41 not only includes an inlet portion 411 and a passage 412, but also includes an outlet portion 413 and an abutting portion 414. As shown in FIG. 9 and FIG. 10, the connecting portion 41 is a hollow tube, which is roughly cylindrical, and the interior thereof is also roughly cylindrical, which is defined as the passage 412. The inlet portion 411 is provided on a side of the passage 412 adjacent to the snap-fitting portion 42, and communicates with the passage 412. The inlet portion 411 has an opening, of which a diameter equals that of the passage 412. The outlet portion 413 is provided on another side of the passage 412 opposite to the inlet portion 411, and also communicates with the passage 412. A diameter of the outlet portion 413 is slightly smaller than that of the passage 412. The abutting portion 414 is an inner wall extending from the passage 412, and is located between the passage 412 and the outlet portion 413. In the current embodiment, the abutting portion 414 particularly refers to the inner wall around the outlet portion 413. The way of connecting the connecting portion 41 and the snap-fitting portion 42 is described below. The elastic member 43 and the rotary ring 44 sequentially fit around the post 424 of the snap-fitting portion 42, wherein an end of the elastic member 43 abuts against the insertion block 421, and another end thereof abuts against the rotary ring 44 which fits around the post 424. By inserting the post 424, which has the elastic member 43 and the rotary ring 44 fitting therearound, all the way through the passage 412 through the inlet portion 411 of the connecting portion 41, the elastic snap-fitting component 424*a* located at the end portion of the post 424 would pass through the passage 412 and the outlet portion 413, being exposed out of the connecting portion 41 to engage with the connecting portion 41, with the rotary ring 44 abutting against the abutting portion 414. Such an arrangement could form a connection relation between the connecting portion 41 and the snap-fitting portion 42 in a way that the connecting portion 41 can be rotated around the axis A of the post 424. Since the elastic member 43 is located between the connecting portion 41 and the snap-fitting portion 42 in an elastically compressible manner, the connecting portion 41 can be moved in a direction in line with the axis A of the post 424 of the snap-fitting portion 42. In other words, the snap-fitting portion 42 can be moved relative to the connecting portion 41, i.e., the snap-fitting portion 42 can reciprocate in and out of the inlet portion 411 of the connecting portion 41. Understandably, the rotary ring 44 is provided mainly for enhancing the smoothness of the relative rotation between the connecting portion 41 and the snap-fitting portion 42. The rotary ring 44 can be a smooth component, which can be easily rotated relative to the abutting portion 414. With the rotary ring 44, the roller tube 31 could be prevented from rotating the elastic member 43 through the connecting portion 41 during its rotation; the rotation of the elastic member 43 may lead to contraction about the post 424, which would hinder the rotation of the post 424. Furthermore, by providing the rotary ring 44, the elastic member 43 could be also prevented from wearing a surface of the abutting portion 414. Therefore, depending on the requirements of overall design and the selection of materials, the elastic member 43 could also directly abut against the abutting portion 414 with the rotary ring 44 omitted, which would not affect the function of the fixing assembly of the present invention.

Figure 10B:
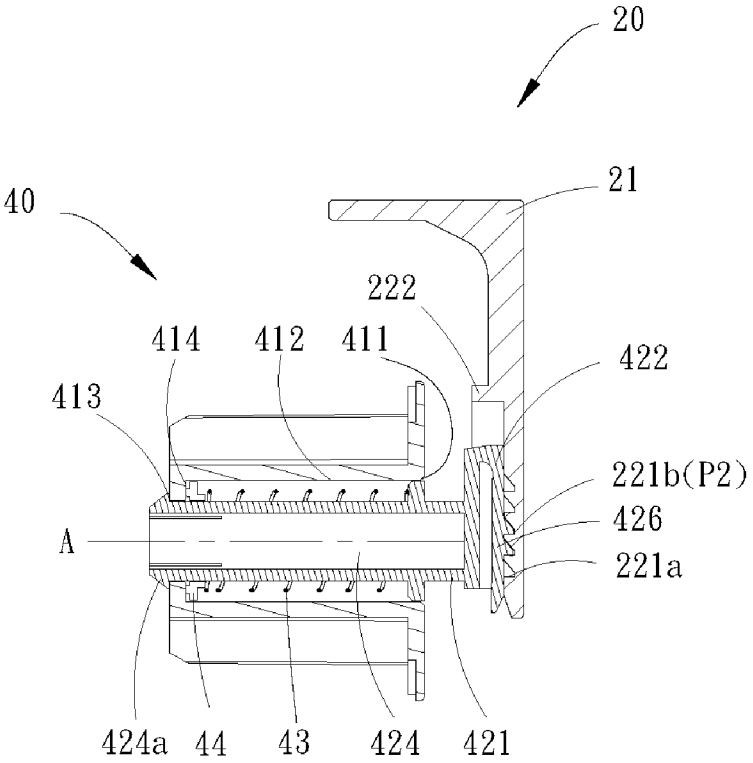
FIG. 10*b* is a sectional view showing the fixing member shown in FIG. 8 is located at a second position relative to the fixing support.
Figure 10A:
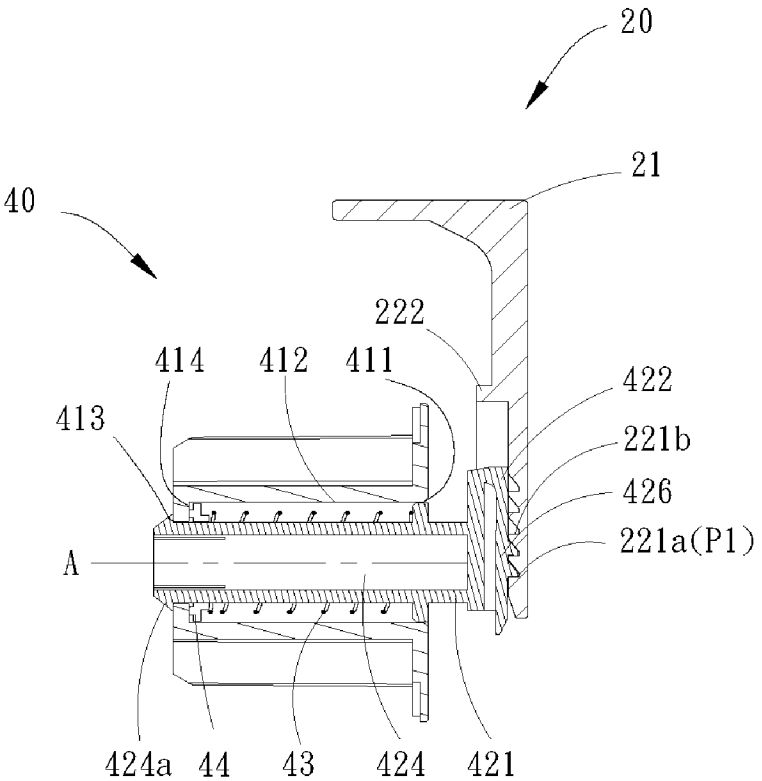
FIG. 10*a* is a sectional view showing the fixing member shown in FIG. 8 is located at a first position relative to the fixing support.

To perform the installation, the fixing member 40 should be pushed upward to where the fixing support 20 is. During such process, the insertion block 421 would gradually go into the install groove 222. Furthermore, as shown in FIG. 9, the elastic plate 422 would be also moved into the slot 221, so that the toothed portion 426 could contact the opening 221*a*. At this time, the elastic plate 422 would slightly bend inward. Due to the elasticity provided by the elastic member 43, the snap-fitting portion 42 would be also slightly squeezed in a direction toward the connecting portion 41, and the toothed portion 426 could snap-fit with the opening 221*a* afterward, whereby the fixing member 40 could be engaged with the fixing support 20 at a first position P1, as shown in FIG. 10*a*. When the fixing member 40 is pushed upward by an external force again, the elastic plate 422 would bend inward again, and the whole snap-fitting portion 42 would be also slightly squeezed inward, so that the toothed portion 426 could be disengaged from the originally engaged opening 221*a*. After that, the toothed portion 426 could be moved upward to snap-fit with the next opening 221*b*. At this time, the fixing member 40 is engaged with the fixing support 20 again, but at a second position P2 this time, as shown in FIG. 10*b*. In the current embodiment, the elastic member is provided to further enhance the smoothness while installing the fixing assembly.

It must be pointed out that the embodiments described above are only some preferred embodiments of the present invention. All equivalent structures which employ the concepts disclosed in this specification and the appended claims should fall within the scope of the present invention.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fixing assembly for fixing a roller shade to an external environment; the fixing assembly comprising:

a fixing member, which comprises a connecting portion and a snap-fitting portion; wherein the snap-fitting portion is connected to the connecting portion, and an end of the snap-fitting portion is exposed out of the connecting portion; and a fixing support, wherein the fixing support comprises a fixing portion and a snap-fitted portion; the fixing portion is adapted to be fixedly connected to the external environment; the snap-fitted portion is fixedly provided on a surface of the fixing portion facing the fixing member; the snap-fitting portion of the fixing member is adapted to be detachably connected to the fixing support; the snap-fitted portion has a first position and a second position, and the snap-fitting portion of the fixing member is adapted to engage with the snap-fitted portion at one of the first position and the second position according to operation.

2. The fixing assembly of claim 1, wherein the snap-fitted portion of the fixing support comprises a slot; the snap-fitting portion of the fixing member comprises an insertion block and an elastic plate; the insertion block is provided in a manner that the insertion block is rotatable relative to the connecting portion; the elastic plate is connected to the insertion block, and extrudes from the insertion block toward the snap-fitted portion, so that the elastic plate is adapted to snap-fit with the slot.

3. The fixing assembly of claim 2, wherein the slot of the snap-fitted portion has at least two openings sequentially arranged; a position of one of the openings is defined as the first position, and a position of another one of the openings is defined as the second position; the elastic plate is adapted to optionally snap-fit with any one of the openings.

4. The fixing assembly of claim 3, wherein the snap-fitted portion of the fixing support further comprises an install groove; the snap-fitting portion of the fixing member further comprises a wing, which is provided on a side of the insertion block; the wing is adapted to be moved into the install groove, guiding the elastic plate to fit into the slot of the snap-fitted portion.

5. The fixing assembly of claim 4, wherein the install groove of the snap-fitted portion is defined by a plurality of outer walls, and has a groove exit formed thereon; the install groove has a guide slope provided adjacent to the groove exit; the groove exit allows the insertion block of the snap-fitting portion of the fixing member to pass therethrough; the wing is adapted to fit into the corresponding one of the outer walls; the elastic plate comprises a bevel, which corresponds to the guide slope.

6. The fixing assembly of claim 5, wherein the openings of the slot of the snap-fitted portion are located inside the install groove, and are surrounded by the outer walls.

7. The fixing assembly of claim 5, wherein the elastic plate comprises a root, a toothed portion, and an end portion; an end of the root is connected to the insertion block, and another end of the root is connected to the toothed portion; an end of the toothed portion opposite to the root is connected to the end portion, the toothed portion of the elastic plate protrudes in a way that the toothed portion is adapted to be engaged with the slot; the bevel is provided at the end portion.

8. The fixing assembly of claim 7, wherein the toothed portion of the elastic plate has ratchet teeth, and an outline of each of the openings matches an outline of the toothed portion so that when the toothed portion snap-fits with the openings, the elastic plate is merely movable in one direction relative to the slot.

9. The fixing assembly of claim 2, wherein the fixing member further comprises an elastic member, which is provided between the connecting portion and the snap-fitting portion, so that the snap-fitting portion is movable relative to the connecting portion, with the end of the snap-fitting portion moving toward or away from the connecting portion.

10. The fixing assembly of claim 9, wherein the connecting portion further comprises an inlet portion, a passage, and an abutting portion; the snap-fitting portion further comprises a post; an end of the post is connected to the insertion block, and another end of the post is adapted to be inserted into the passage through the inlet portion; when inserted therein, the insertion block is exposed out of the inlet portion, and is adapted to be rotatable relative to the connecting portion with the post served as a rotation axis; the elastic member fits around the post, and is located between the abutting portion and the insertion block, so that the post is adapted to reciprocate in or out the inlet portion of the connecting portion.

11. The fixing assembly of claim 10, wherein the fixing member further comprises a rotary ring, which fits around the post and abuts against the abutting portion; the elastic member abuts against the rotary ring and the insertion block, respectively.

* * * * *